US005839047A

United States Patent [19]

Hirabayashi et al.

[11] Patent Number: 5,839,047

[45] Date of Patent: Nov. 17, 1998

[54] SHEET-SIZE DETECTION MECHANISM FOR SHEET CASSETTES AND IMAGE-FORMING-APPARATUS USING THE SAME

[75] Inventors: Yoshihiro Hirabayashi, Hyogo; Hiroyuki Okitsu; Hideyuki Nanba, both of Kawasaki, all of Japan

[73] Assignee: Fujitsu Limited, Kawasaki, Japan

[21] Appl. No.: 7,965

[22] Filed: Jan. 22, 1993

[30] Foreign Application Priority Data

| | | | |
|---|---|---|---|
| Jan. 28, 1992 | [JP] | Japan | 4-013052 |
| Sep. 18, 1992 | [JP] | Japan | 4-249760 |

[51] Int. Cl.[6] ..... G03G 21/00; B65H 1/04

[52] U.S. Cl. ..... 399/389; 271/171

[58] Field of Search ..... 355/308, 311; 271/144, 171, 255; 399/376, 389

[56] References Cited

U.S. PATENT DOCUMENTS

| | | | |
|---|---|---|---|
| 4,697,803 | 10/1987 | Kan et al. | 271/171 X |
| 5,273,272 | 12/1993 | Nakamura et al. | 271/171 X |

FOREIGN PATENT DOCUMENTS

| | | | |
|---|---|---|---|
| 17 97 364 | 4/1971 | Germany . | |
| 28 23 889 | 12/1978 | Germany . | |
| 59-172332 | 9/1984 | Japan | 271/171 |
| 59-207332 | 11/1984 | Japan | 271/171 |
| 59-227636 | 12/1984 | Japan | 271/171 |
| 60-209442 | 10/1985 | Japan | 271/171 |
| 60-209443 | 10/1985 | Japan | 271/171 |
| 60-262734 | 12/1985 | Japan | 271/171 |
| 1-87431 | 3/1989 | Japan | 271/171 |
| 2-276728 | 11/1990 | Japan | 271/171 |
| 3-88629 | 4/1991 | Japan . | |
| 4-45017 | 2/1992 | Japan | 271/171 |
| 4-59517 | 2/1992 | Japan | 271/171 |
| 4-59520 | 2/1992 | Japan | 271/171 |
| 4-153126 | 5/1992 | Japan | 271/171 |
| 4-260541 | 9/1992 | Japan | 271/171 |
| 58-167333 | 10/1993 | Japan . | |

OTHER PUBLICATIONS

Patents Abstracts of Japan — No. 1–87431 "Detecting Mechanism for Type of Paper"— M–847, Jul. 11, 1989 vol. 13, No. 299.

Patents Abstracts of Japan — No. 2–276728 "Paper Feeding Cassette"— M–1075, Jan. 30, 1991 vol. 15, No. 39.

*Primary Examiner*—Fred L. Braun

*Attorney, Agent, or Firm*—Armstrong, Westerman, Hattori, McLeland, & Naughton

[57] ABSTRACT

An image-forming apparatus for a sheet cassette that contains the sheets to be processed by hardware and is loaded in the hardware. The apparatus has a display window provided on a front panel of the sheet cassette, a sheet size display member displaying a letter indicating a sheet size, and the sheet size display member including a sheet size-definition member that enables a sheet size to be defined in the form of capable of detecting the sheet size. Whereby, the letter showing the desired sheet size can be manually indicated on the display window, and sheet size detector for detecting the sheet size-definition member of the sheet size display member, thereby detecting the sheet size indicated on the display window.

5 Claims, 15 Drawing Sheets

SHEET-SIZE DETECTION MECHANISM FOR SHEET CASSETTES AND IMAGE-FORMING-APPARATUS USING THE SAME

BACKGROUND OF THE INVENTION

1. Field of the Invention

The present invention relates generally to a sheet size-detection mechanism for sheet cassettes and an image-forming apparatus using that mechanism, and more particularly to a sheet size-detection mechanism for displaying and detecting the size of sheets contained in a sheet cassette loaded in hardware and an image-forming apparatus using that mechanism.

2. Description of the Related Art

In a current image-forming apparatus such as copiers, printers and facsimiles, the automatic feeding of sheets to the image-forming apparatus is achieved by loading a sheet cassette containing sheets that are printing media handled with in the image-forming apparatus. Recently, such image-forming apparatus has been required to accommodate to sheets of various sizes, for instance, those of sizes B5, A4, B4, A3, etc.

The loading of all such sheet cassettes of various sheet sizes into the image-forming apparatus incurs an increase in the size thereof, which is contrary to recently demanded space savings. Thus, the number of sheet cassettes loaded in the image-forming apparatus is now limited. Provision of sheet cassettes of various sheet sizes, on the other hand, means that some unavailable sheet cassettes must be stored or placed somewhere. For these or other reasons, sheet cassettes are now designed such that they can contain sheets of various sizes. In the case of an image-forming apparatus on which these type of cassettes are mounted, however, it is necessary to detect the size of the sheets contained in the cassettes.

Particular attention is now paid to the so-called front loading type of printing apparatus that, as illustrated in FIG. 19(A), is such designed as to allow the operator to load or unload sheet cassettes 2*a* and 2*b* in or from the printing apparatus through the front thereof. This type of printing apparatus works much more efficiently than a conventional type of printing apparatus in which loading or unloading of a sheet cassette is done from the sides thereof, because it can be set up in a space commensurate with its width and enables the operator to confirm which of the cassette 2*a* or 2*b* is loaded and replace one of the cassettes with the other from its front side. In this printing apparatus, sheets are fed out of the sheet cassettes 2*a* and 2*b* for printing by a printing mechanism 3, and are then ejected onto the printing apparatus.

As mentioned above, such sheet cassettes 2*a* and 2*b* are capable of containing sheets of various sizes. Consequently, they are each designed to tell the user what sizes of sheets are contained therein by providing the front panel 21 of a sheet holder 20 with a label case 22 and placing a sheet size-bearing label 40 in the label case 22, as shown in FIGS. 19(B) and (C). In an alternative approach, sheet size is displayed on a rotary indicator 40' provided on the front panel 21 by its selective operation.

A printing apparatus, on the other hand, cannot work to feed sheets according to the prescribed sheet size, unless it is told or transmitted the sizes of the sheets contained in the sheet cassettes 2*a* and 2*b*. For this reason, the sheet cassette 2 has a size-definition mechanism 23 provided on a rear portion of the sheet cassette 2. The size-definition mechanism 23 includes size-definition members 41 provided in positions in the size-definition mechanism 23, which are selected in accordance with the sheet size of sheets contained in the cassette 2. Then, a sheet cassette holder slot 11 in the printing apparatus is provided on its rear portion with a size detector 10 such as one made up of a microswitch, as shown in FIGS. 19(B) and 20. When the sheet cassette 2 is loaded in the slot 11 in the printing apparatus, the positions of the size-definition members 41 of the size-definition mechanism 23 are detected by the size detector 10 to detect the size of the sheets contained in the loaded sheet cassette 2.

In the prior art, however, much time and labor are needed for replacing the sheets contained in the sheet cassette 2 with different size of sheets, because it is required not only to replace the label 40 with different one and alter the indicator elements on the rotary indicator 40' but also to change the alignment of the size-definition members 41 with different one. There are some possible human factors as well; for instance, the operator often forgets to alter the size-definition members 41 or presets the size-definition member 41 in error, after the operator has changed the label 40 or the indicator elements on the rotary indicator 40'. In such cases, there is a difference between the size of the sheets contained and the sheet size detected, making it unable to obtain prints of the desired size. Furthermore, the need of both the size-definition member 41 and the label 40 incurs some considerable expense, because these members should be kept in store for each sheet size, and much time and labor are needed for storing and maintaining these members as well.

OBJECT AND SUMMARY OF THE INVENTION

It is therefore an object of the invention to provide a sheet size-detection mechanism for sheet cassettes from which the problems mentioned in connection with the prior art are substantially eliminated, and an image-forming apparatus using that mechanism.

Another object of the invention is to provide a sheet size-detection mechanism for a sheet cassette that simplifies sheet size indication and sheet size-definition operation when altering the size of the sheets contained in the sheet cassette and an image-forming apparatus using that mechanism.

A further object of the invention is to provide a sheet size-detection mechanism for sheet cassettes that uses an improved size display means, thereby bringing sheet size indication in coincidence with sheet size determination, and an image-forming apparatus using that mechanism.

According to the invention, the sheet size-detection mechanism for a sheet cassette that contains sheets to be processed by a hardware and is loaded in the hardware, includes a display window provided on a front panel of the sheet, size display means displaying a letter indicating a sheet size, said size display means including size-definition means in which the sheet size is defined in the form capable of detecting the sheet size, whereby the letter indicating the desired sheet size are manually defined on said display window, and a detection means for detecting said size-definition means of said size display means, thereby detecting the sheet size indicated on said display window.

According to the invention wherein the size display means is provided with the sheet size-indicating letters and the size-definition means in the form capable of detecting said sheet size, it is possible to display and detect the size of the sheets contained in the sheet cassette by defining the desired size-indicating letters manually on the display window by the size display means, thereby reducing the time and labor needed by the operator when the operator replaces the sheets contained in the sheet cassette with those of different size and preventing the operator's mis-definition.

Other features and advantages of the present invention will be apparent from the following description taken in conjunction with the accompanying drawings.

DESCRIPTION OF THE PREFERRED EMBODIMENTS

Figure 1A:
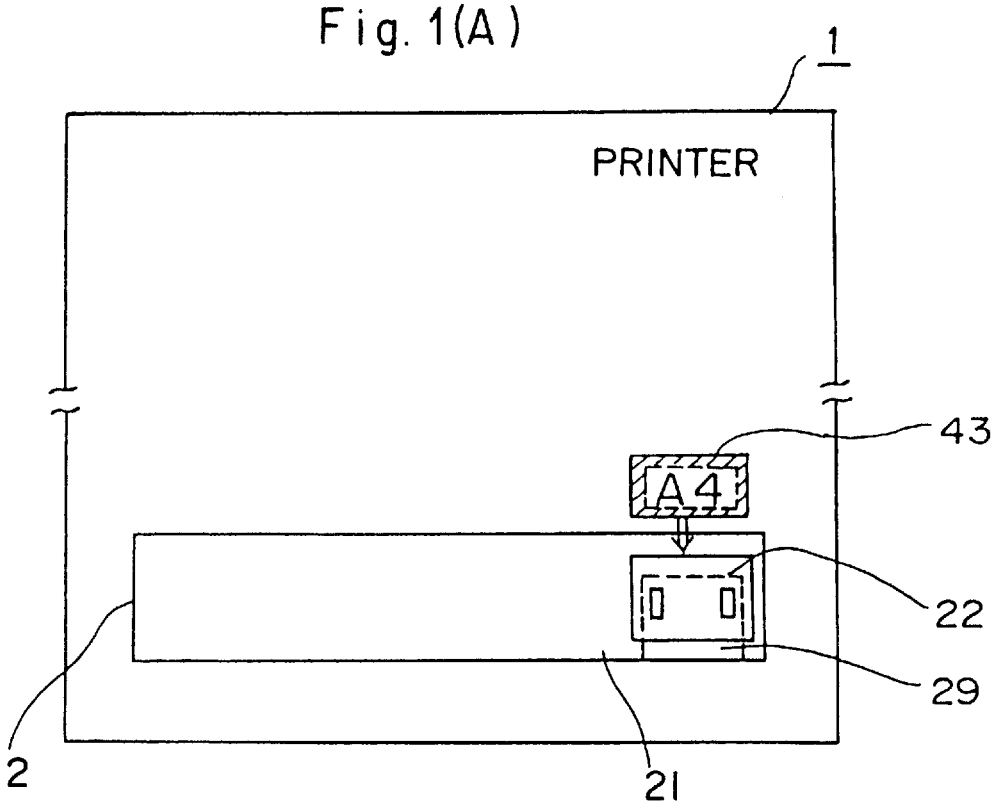
FIGS. 1(*a*) and 1(*b*) are schematic illustrations of one embodiment of the sheet size-detection mechanism used with the sheet cassette according to the invention, FIG. 1(*a*) being a front view and FIG. 1(*b*) being a top view.
Figure 1B:
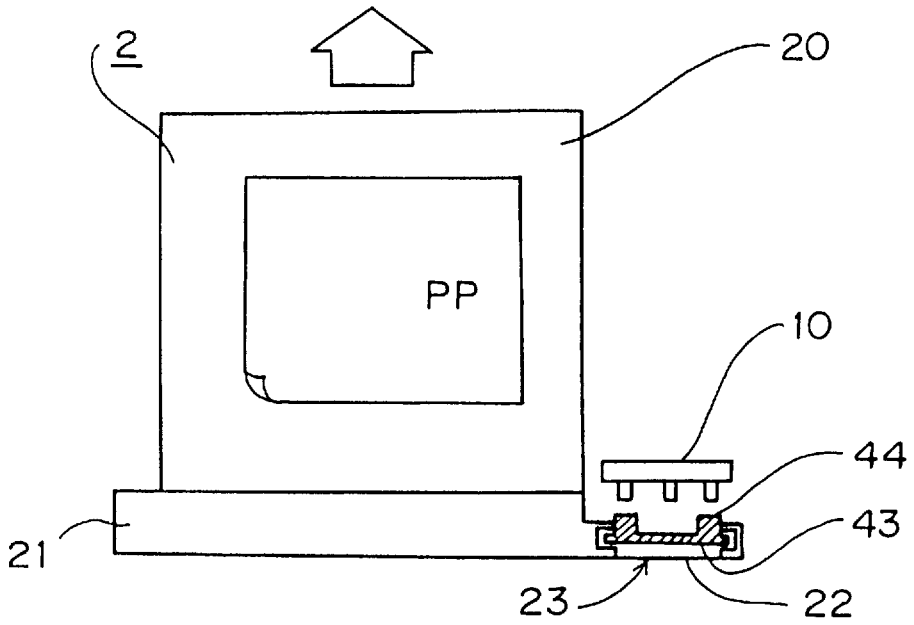
Figure 2:
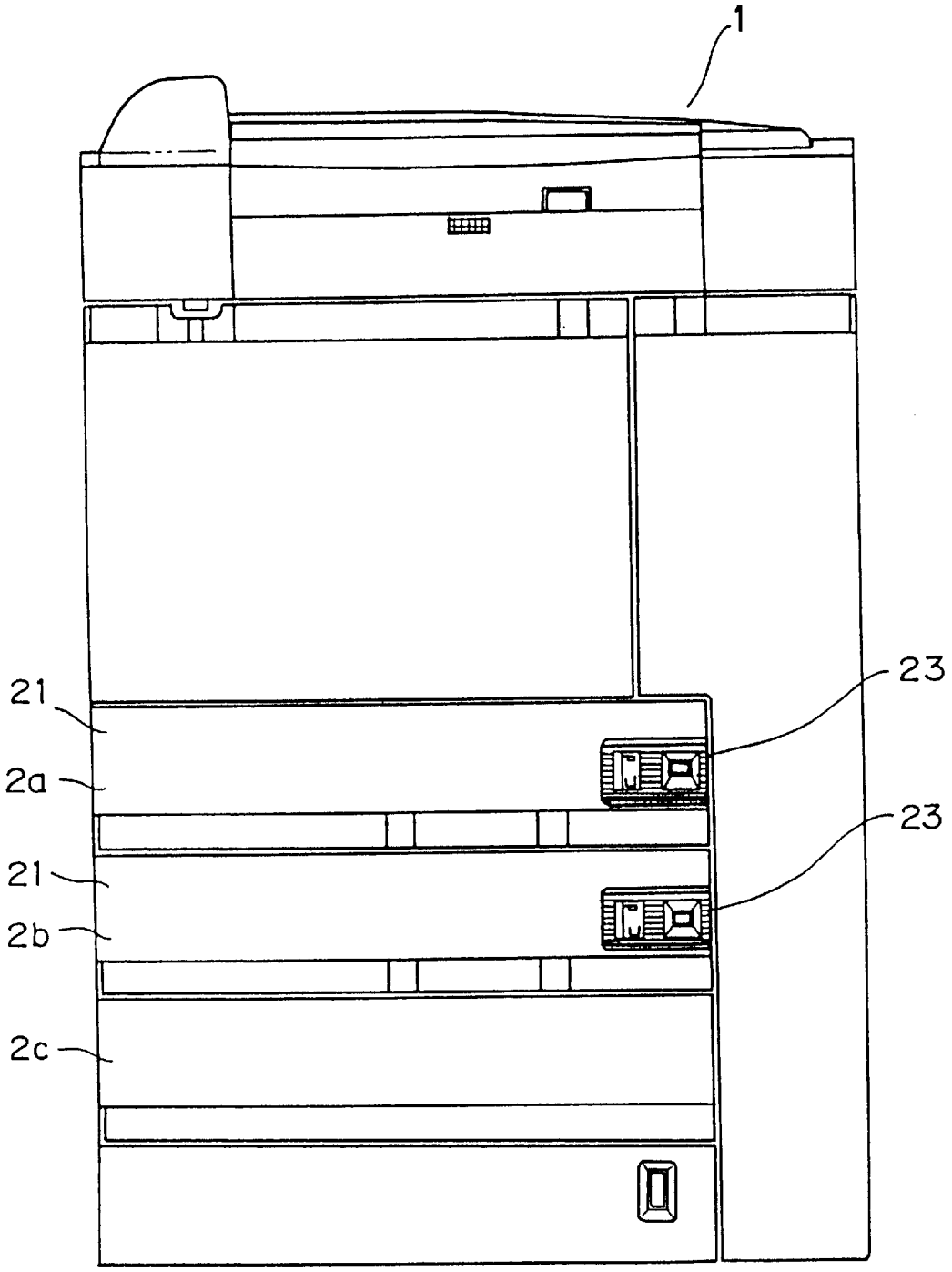
FIG. 2 illustrates the appearance of the image-forming apparatus according to the invention.
Figure 3:
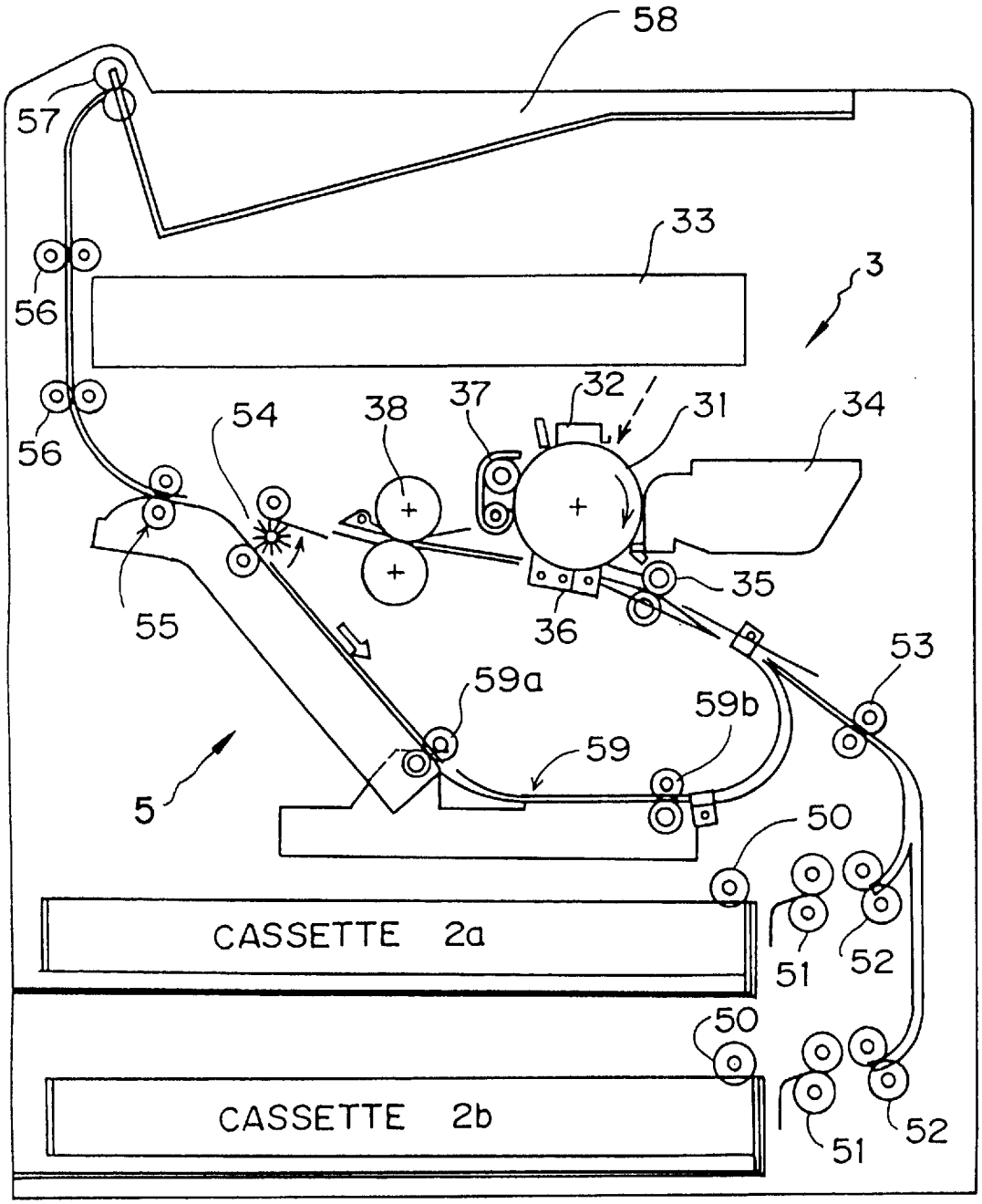
FIG. 3 illustrates the construction of the image-forming apparatus according to the invention.

An image-forming apparatus shown in FIGS. 2 and 3 is in the form of an electrophotographic printer. As shown in FIG. 2, the printer shown generally at 1 includes a two-stage type of sheet cassettes 2*a*, 2*b* and a pre-cassette 2*c* located below 2*b*. These sheet cassettes 2*a*, 2*b* and 2*c* can be loaded or unloaded in or from the printer 1 from its front side, and the sheet cassettes 2*a* and 2*b* are each provided with sheet size-display windows 23 on a front panel 21 of the sheet cassettes 2*a* and 2*b*.

As illustrated in FIG. 3, the printer 1 is constructed from a printing mechanism 3 built up of an electrophotographic unit such that paper can be printed on both its sides. The printing mechanism 3 is made up of a rotary photoconductive drum 31, a charger 32 for charging the photoconductive drum 31, a (laser) optical system unit 33 for writing a light image onto the photoconductive drum 31 to generate a latent image, a development unit 34 for developing the latent image on the photoconductive drum 31 with toner, a resist roller 35 with a sheet to be transferred on, a transfer/separation means 36 for transferring the toner image on the photoconductive drum 31 onto the sheet fed through the resist roller 35 and separating it therefrom, a cleaner unit 37 for cleaning the photoconductive drum 31 after the transfer, and a heat roller fixing means 38 for the heat fixation of the toner image on the sheet.

A sheet feeding system shown generally at 5 is built up of pickup rollers 50 for picking up sheets from the cassettes 2*a* and 2*b*, feed rollers 51, 52 and 53 for feeding the picked-up sheets to resist rollers 35, rotary impellers 54 for directing the trailing or rear end of the sheet fed out of the heat roller fixer 38 to a back face-printing feed passage 59, switch-back rollers 55 for feeding the sheet from the heat roller fixer 38 in the eject direction and then feeding it to the back side-printing feed passage 59, guide rollers 56 for guiding sheet eject, eject rollers 57, a tray 58 for receiving the sheets ejected, and the back side-printing feed passage 59 for feeding the sheet from the switch-back rollers 55 to the resist rollers 35 through feed rollers 59*a* and 59*b* for the purpose of back face-printing.

As the printer 1 operates, a sheet of the prescribed size is picked up by the pickup rollers 50 from within the sheet cassette 2*a* or 2*b*, fed through the feed rollers 51, 52 and 53 to the resist rollers 35, while the photoconductive drum 31 is charged through the charger 32, then, is written through the optical system unit 33 to generate a latent image, and is developed through the development unit 34 to generate a toner image.

As the sheet is fed through the resist rollers 35, the toner image is transferred from the photoconductive drum 31 onto its surface through the transfer/separation means 36. The sheet is then separated from the photoconductive drum 31. After that, the toner image on the separated sheet is then fixed through the heat roller fixer 38, then fed toward the switch-back rollers 55, and finally fed toward the eject tray 58 through the switch-back rollers 55. Upon the rear end of the sheet reaching the impellers 54, the switch-back rollers 55 stops their delivery action to stop the sheet. In this state, the sheet's rear end comes in contact with the impellers 54. After that the feeding direction of the sheet is changed toward the back face-printing feed passage 59, because the impellers 54 rotate counterclockwise. Now, the switch-back rollers 55 are reversed in rotation to feed the sheet to the back face-printing feed passage 59, so that the sheet can be fed through the feed rollers 59*a* and 59*b* of the feed passage 59 to the resist rollers 35.

As is the case with front side-printing, the sheet is subsequently fed through the resist rollers 35, so that the toner image can be transferred from the photoconductive drum 31 onto the sheet and fixed thereon through the heat roller fixer 38, followed by the feeding of the sheet toward the switch-back rollers 55. Furthermore, the sheet is delivered through the switch-back rollers 55 toward the eject tray 58 and then ejected through the eject rollers 57 to the eject tray 58 for making double-sided printing complete.

In the case of one-sided printing, it is noted that the sheet is ejected onto the eject tray 58 after it has been printed on its one or front side.

The printer 1 dispenses with providing any sheet space on both its sides and so makes it possible to achieve space saving, because the sheet cassettes 2*a* and 2*b* are inserted through the printer body from its front side and the printed sheets are ejected onto the eject tray 58 located above.

Explanation will now be made of the sheet cassettes and sheet size-detection mechanism with reference to FIGS. 1, 4, 5 and 6.

Figure 5:
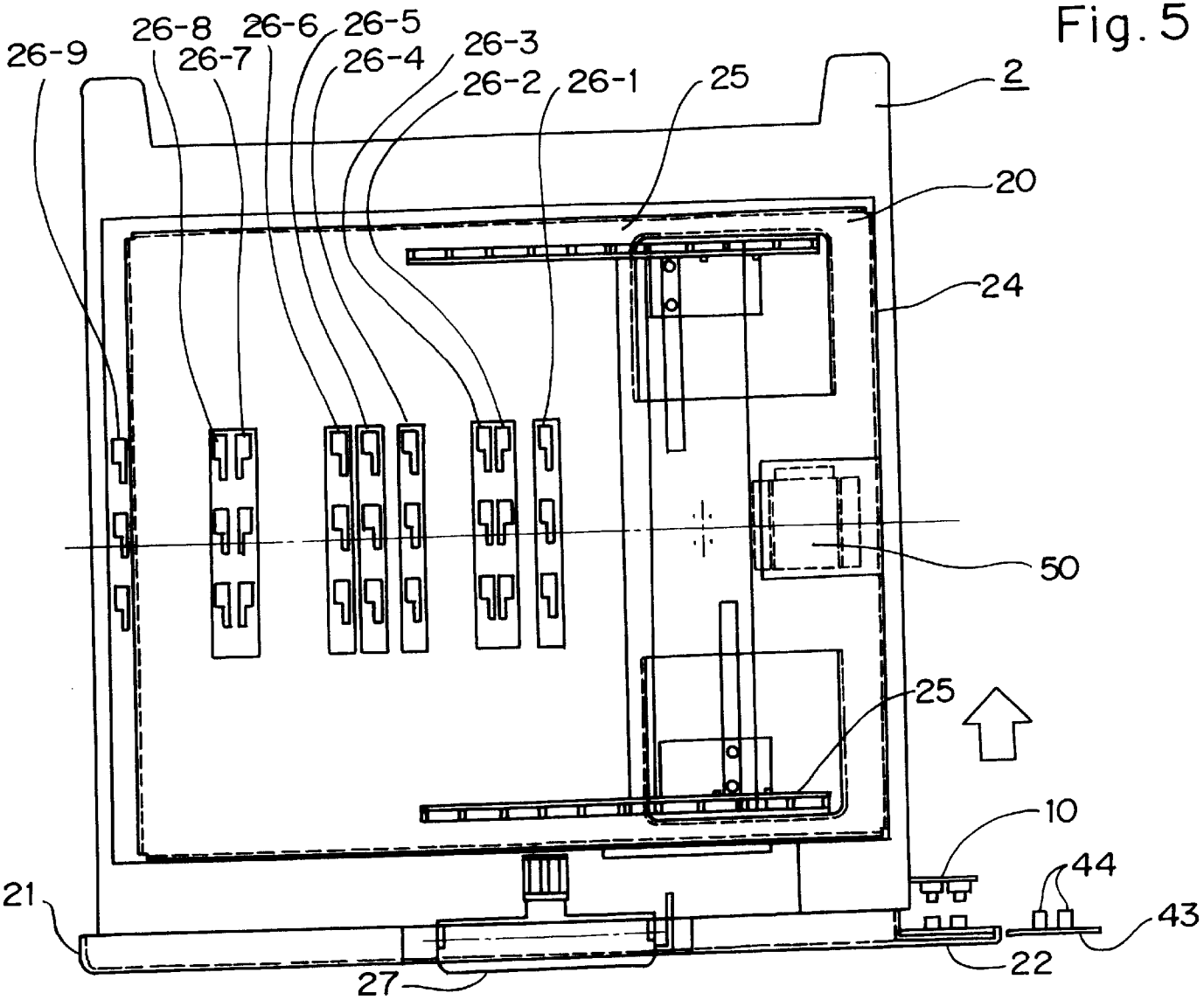
FIG. 5 is an upper view of one embodiment of the sheet cassette according to the invention, FIG. 6(*a*) is a front view and FIG. 6(*b*) is a side view of one embodiment of the sheet cassette according to the invention.

As can be best seen from FIG. 5, a sheet cassette 2 is built up of a sheet holder 20 and its front panel 21. The sheet holder 20 includes a right edge guide 24 on which the right edges of the sheets held are to abut, displaceable guides 25 for guiding both ends of the sheets held and left edge guide members 26-1 to 26-9 that are engaged with guide members (which will be explained at great length with reference to FIG. 7) for guiding the left edges of the sheets held.

As illustrated, nine left edge guides 26-1 to 26-9 are provided so as to accommodate to various sheet sizes. To be more specific, the guide 26-1 is provided for size B5, lengthwise; 26-2 for size A4, widthwise or size A5, lengthwise; 26-3 for letter size, widthwise; 26-4 for size B5, lengthwise; 26-5 for letter size, lengthwise; 26-6 for size A4, lengthwise; 26-7 for legal size; 26-8 for size B4; and 26-9 for size A3.

Each sheet is held in the sheet holder 20, while it abuts at the leading or front edge on the right edge guide 24 and regulated at its rear edge by the guide members 28 oriented by the guides 26-1 to 26-9, and is picked up by the pickup rollers 50 for use.

Figure 6A:
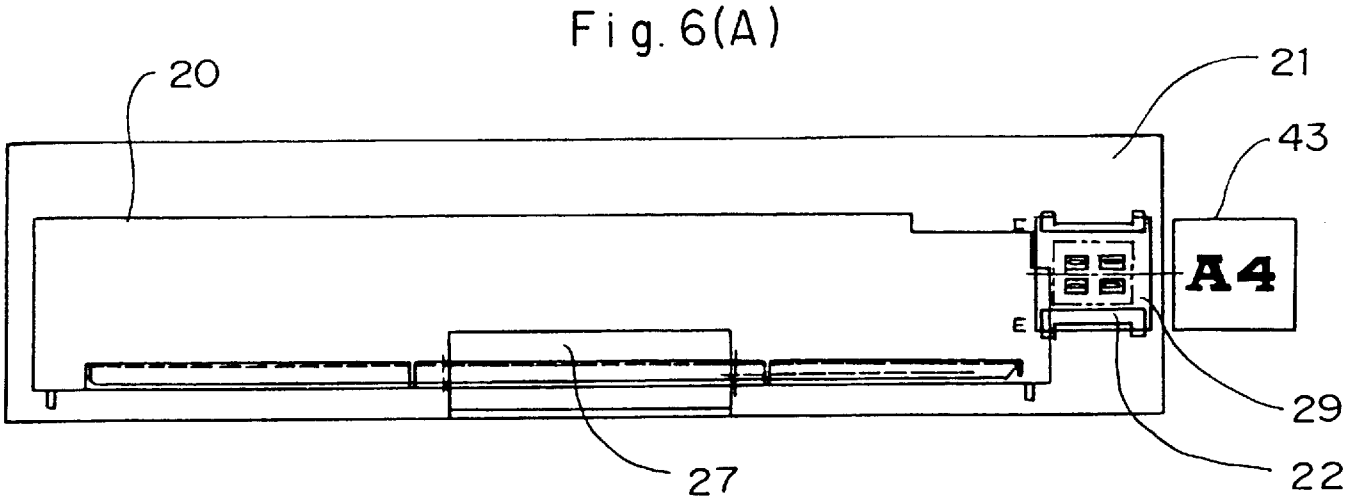
Figure 6B:
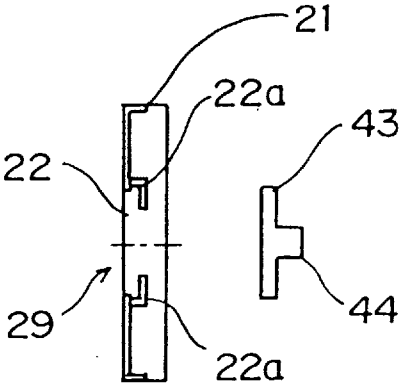

On the other hand, the front panel 21 is provided on its middle with a drawer handle 27 and at the right end that is a position not corresponding to the sheet holder 20 with a display window 29 and a label case 22, as illustrated in FIGS. 5 and 6(A). The display window 29 is formed as a through-hole to the front panel 21, but it may be a cut-out portion made at a corner or an edge of the front panel 21. As can be best seen from FIG. 6(B), the label case 22 includes upper and lower guides 22*a* (providing a guide slot therebetween, as shown—the guide slot, or slot, enabling linear transverse motion of a label 43 (discussed below)) and is open on the front (left in FIG. 6(B)) and back (right in FIG. 6(B)) sides.

Figure 4:
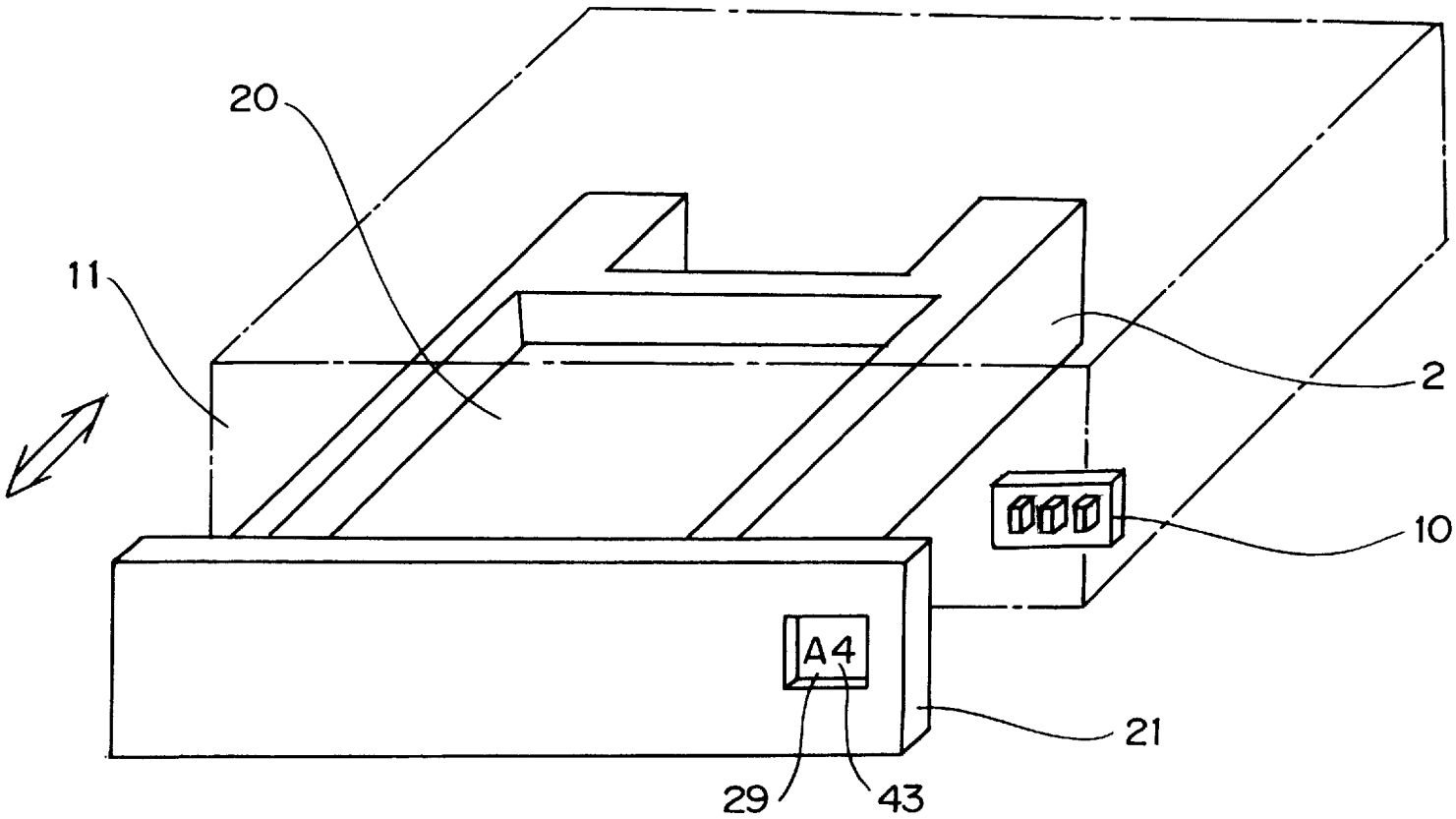
FIG. 4 is a constructional illustration of one embodiment of the sheet cassette and sheet size-detection mechanism according to the invention.

A label 43—that is a size display member/label support member—bears letters indicating sheet size (e.g., A4, as illustrated) on the front surface of the label 43, and includes on the back side two sites on which projections serving as a size-definition member 44 are provided, corresponding to a sheet size. In FIG. 5, size A4, for instance, is indicated by two projections. As shown in FIGS. 4 and 5, the printer body is correspondingly provided with a size detector 10 on the right side of a slot 11 into which the sheet cassette 2 is to be loaded. The size detector 10 is made up of two microswitches corresponding to the two projection positions, thereby detecting the projection from the size-definition member 44 on the back side of the label 43 extending from the open back side of the label case 22.

As the label 43 indicating the sheet size corresponding to that of the sheets held is inserted in the label case 22 on the front panel 21 of the constructed sheet cassette 2, the sheet size-indicating letters (e.g., A4) on the surface of the label 43 appear on the display window 29 in the front panel 21, and the projections that are the size-definition members 44 of the label 43 are exposed on the back side of the label case 22.

As the sheet cassette 2 is loaded in the associated slot 11 in the printer 1, as shown in FIG. 4, the label case 22 on the front panel 21 of the sheet cassette 2 is located at a position corresponding to the size detector 10, so that the projections—that are the size-definition members 44 of the label 43 inserted in the label case 22—can give a push on the microswitches of the size detector 22, thereby enabling sheet size to be detected by the projections' positions.

In the instant embodiment, size A4 detection is achieved by allowing two projections forming the size-definition members 44 to give a push on the two microswitches of the size detector 10 for actuation. It is here noted that the width itself of the front panel 21 may be equal to that of the sheet holder 20. However, this is disadvantageous in that the size detector 10 incorporated in the printer causes obstruction to loading the sheet cassette 2 in the slot 11. In the invention, therefore, a right-handed extension corresponding to the label case 22 is provided to form an additional space, so that the sheet cassette can be loaded in the slot in the printer body irrespective of the presence of the size detector 10 in the printer body.

The size-definition members 44 of the label 43, because of including two projection positions, give two-bit size information, thus enabling three sheet sizes to be expressed in terms of the presence or absence of the projections. When the size-definition members 44 are defined by projections, as mentioned above, the label 43 including the size-definition members 44 can be obtained by one-piece molding of synthetic resin, making it possible to provide the label 43 at extremely low costs.

The size detector 10 built in the printer, if made up of microswitches as in the instant embodiment, serves well and is provided inexpensively. In addition, only the attachment of the sheet cassette 2 is needed for detecting the size of the sheets placed on the sheet cassette 2, thereby assuring that sheet size can be detected.

If the size-definition member 44 is provided on the back side of the label 43 that is a size-indication member as in the instant embodiment, only the replacement of the label 43 is needed for indicating and detecting different sheets, thus reducing the time and labor needed for sheet replacement. In addition, the sheets contained in a sheet cassette are most unlikely to differ from the sheets to be detected in terms of size. Furthermore, only one label 43 is needed for each size so as to indicate and define sheet size, making some contribution to cost reduction.

In the instant embodiment, the size-definition member 44 of the label 43 is defined by projections and the size detector 10 is made up of microswitches (mechanical switches). In the invention, however, it is understood that the size-definition member 44 may be defined as by magnets, while the size detector 10 may be made up of magnetic sensors. Alternatively, the size-definition member 44 may be expressed by a bar code, while the size detector 10 may be made up of an optical sensor. In short, what is essentially needed in the invention is to use any desired combination definition member and sensor capable of determining sheet size.

Although the size-definition member 44 are expressed in terms of two bits, it is understood that it may be done by three or more bits so as to enable many more sheet sizes to be detected. While the label case 22 is located at the right end of the front panel 21, it is understood that it may be positioned at the left end. Furthermore, the label case 22 may be located somewhere in the upper or lower portion of the front panel 21, unless it is detrimental to the sheet holder 20.

While the instant embodiment has been described as using paper as sheet, it is noted that other printing media may be used as well; while the instant embodiment has been described as using the printer as the image-forming apparatus, it is noted that other image-forming hardware such as copiers or facsimiles may be used as well; and while the instant embodiment has been described as using the electrophotographic mechanism as the printing mechanism, it is noted that other printing mechanisms such as heat ink transfer or ink jet mechanisms may be used as well.

The left-end guide structure of the sheet cassette 2 will now be explained more specifically with reference to FIGS. 7 through 10.

Figure 7:
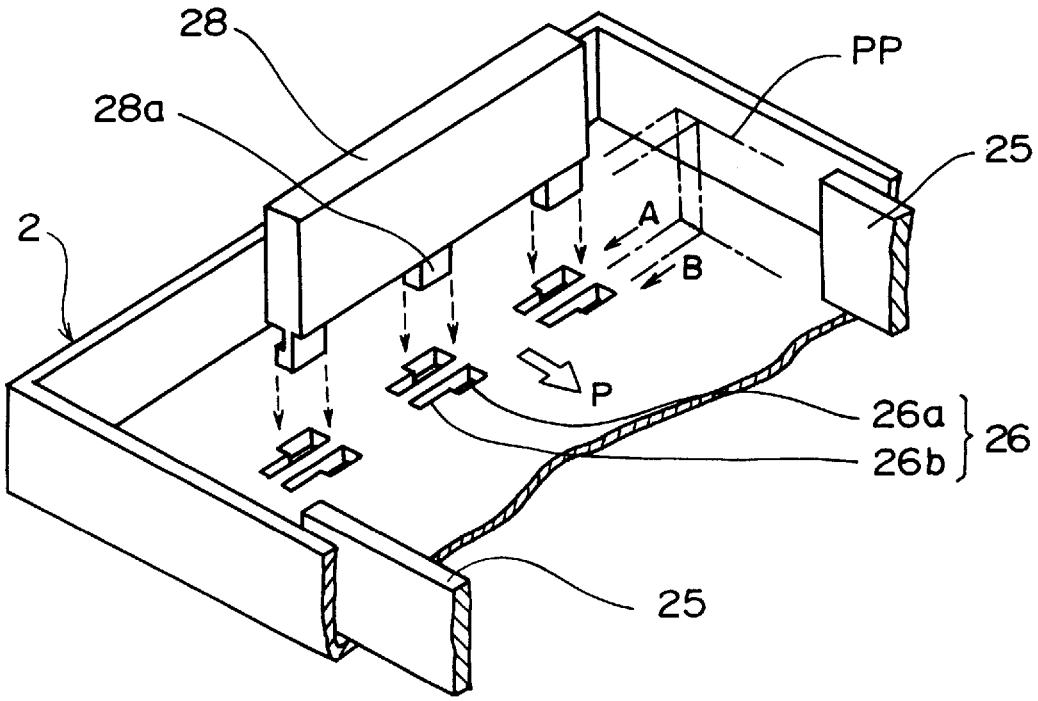
FIG. 7 is a perspective view of one embodiment of the sheet position-regulation means used with the sheet cassette according to the invention.

As shown in FIGS. 5 and 7, each of the left-end guides 26-1 to 26-9 is defined by a series of three stepped slots 26, and the guide member 28 is provided on its bottom with a hook form of three lock pawls 28*a* that are engaged within the three slots 26.

The guide member 28 serves as a stopper member for putting sheets' edge faces in order, and is provided on its bottom with a plurality of hooked lock pawls 28*a* that are all bent in one of the directions normal to the stopper surface. This guide member 28 may be easily formed of material such as synthetic resin.

The stepped slots 26 are formed in the bottom of the sheet cassette 2 and provided at a pitch that corresponds to that of the hooked lock pawls 28*a*. It is noted that each hole 26 comprises a hole 26*a* through which the lock pawl 28*a* is inserted and a hole 26*b* through which the lock pawl 28*a* is moved in the direction normal to the sheet-feed direction P for locking it, said holes being integrally molded.

Figure 10:
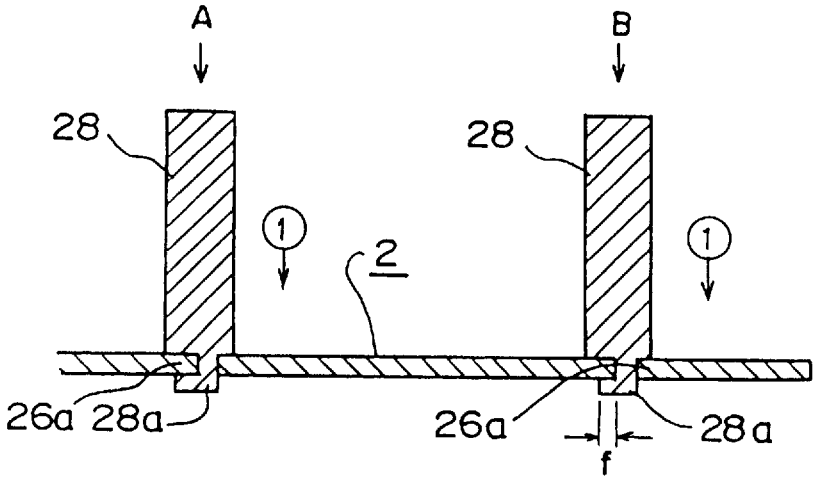
FIG. 10 is an illustration of how sheet position control is achieved in the sheet cassette according to the invention.

In order to engage the guide member 28 within the stepped slots 26, the hooked lock pawl 28*a* is inserted into the hole 26*a* to the root at Step 1, as shown in FIG. 10. At the next Step 2, the lock pawl 28*a* is forced in the hole 26*a* in the direction opposite to the sheet-feed direction P until its neck site abuts on the wall, as can be best seen from FIG. 9. At the final Step 3, the lock pawl 28*a* is moved in the direction shown by an arrow B, and then locked at its neck site in the hole 26*b*.

The detachment of the guide member 28 from the stepped slots 26 is achieved by the procedures contrary to those mentioned above.

The guide member 28 is engaged in, or disengaged from, each of the left-end guides 26-1 to 26-9 so as to accommodate to sheets of various sizes. As shown in FIG. 5, however, a standard size of recording sheets usually include those of approximate sizes, like size A4 or 210×297 and letter size or 215.9×279. For these sheets of approximate sizes, it is required to locate the left-end guides 26-2 and 26-3. This is also true of size B4 and legal size.

Figure 8:
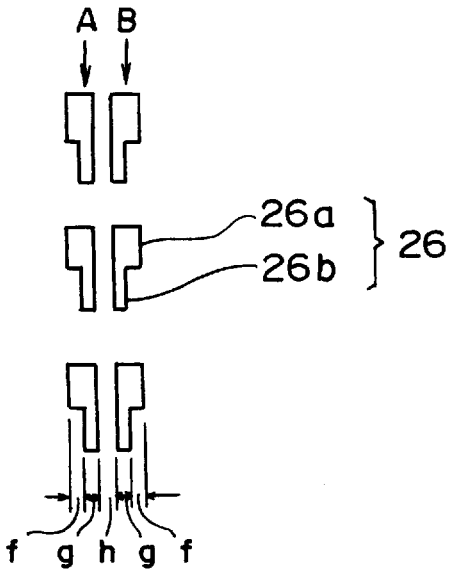
FIG. 8 is an illustration of one embodiment of the sheet position-regulation holes used with the sheet cassette according to the invention.
Figure 9:
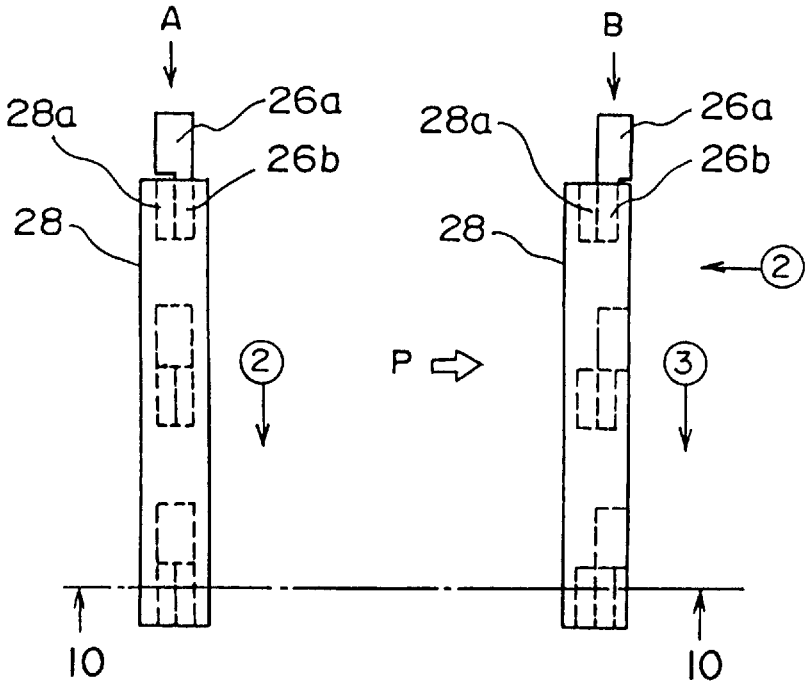
FIG. 9 is an illustration of how sheet position is regulated in the sheet cassette according to the invention.

In order to accommodate to such sheets of approximate sizes, the invention makes use of the following structure. Here the left-end guides 26-3 and 26-2 are designated as rows A and B, respectively. As shown in FIGS. 7 and 8, the stepped slots 26 in the rows A and B are arranged symmetrically in step configuration. In FIG. 8, h stands for the gap size between the rows A and B, g denotes the width of each lock hole 26*b* and g+f represents the width of each hole 26*a*.

In order to engage the guide member 28 within the stepped slots 26 in the row B, the hooked lock pawl 28*a* is inserted into the hole 26*a* to the root at Step 1, as shown in FIG. 10. At the next Step 2, the lock pawl 28*a* is forced in the hole 26*a* in the direction opposite to the sheet-feed direction P until its neck site abuts on the wall, as can be best seen from FIG. 9. At the final Step 3, the lock pawl 28*a* is moved in the direction shown by an arrow B, and then locked in the hole 26*b*. In other words, the lock pawl 28*a* remains locked at its bent hook portion (of a size shown by f) in the lock hole 26*b*.

The guide member 28 is more easily engaged within the stepped slots 26 in the row A rather than in the row B. At the first Step 1 the hooked lock pawl 26*a* is inserted into the stepped slot 14 to the root, as shown in FIG. 10. At the next Step 2 the lock pawl 26*a* is moved in the direction shown by an arrow A for locking.

The difference between engaging the guide member in the slots in the row A and engaging the guide member in the slots in the row B lies in whether or not the guide member is moved in the direction opposite to the sheet-feed direction P after Step 1. In other words, the symmetrical arrangement of the stepped slots in the rows A and B enables the space h between the stepped slots 26 to be reduced by the size f shown in FIG. 8 (that corresponds to the length of the hooked bent of each lock pawl 26*a* shown in FIG. 7). Even with sheets of approximate sizes, therefore, the guide member 28 can be easily held in place at a location narrower than the space h between the rows A and B. In addition, the guide member 28 can be held in place in a single operation.

Another embodiment of the invention will now be explained at great length with reference to FIGS. 11 through 14.

Figure 11:
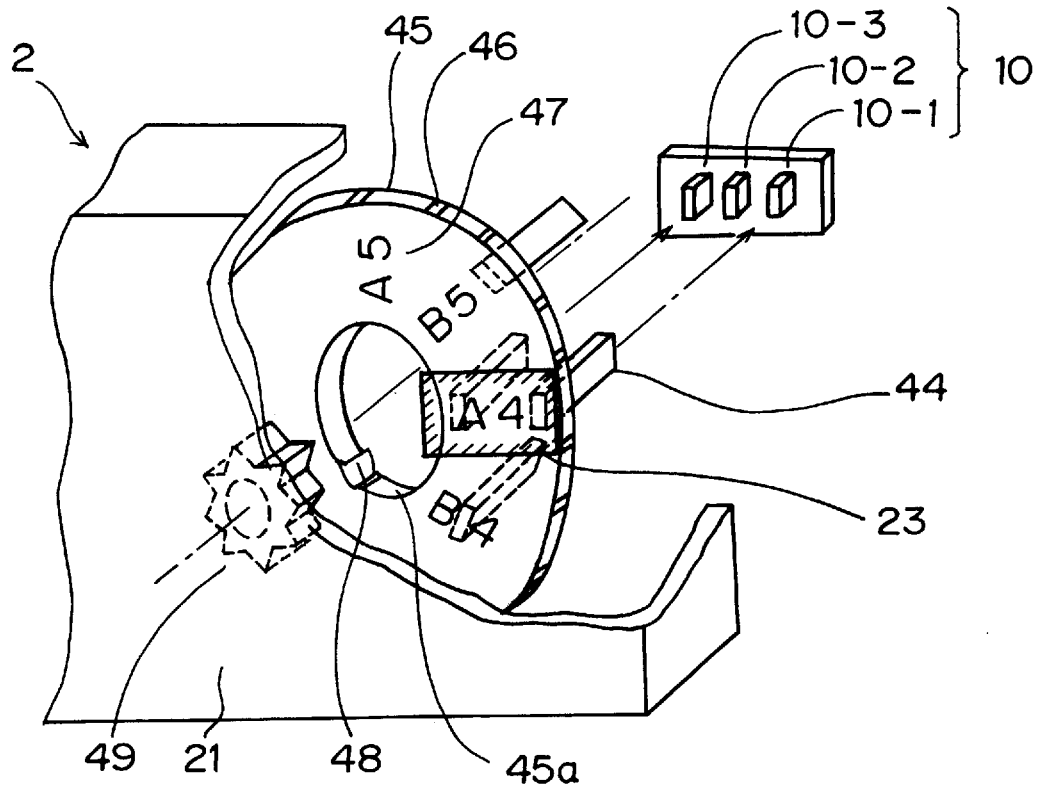
FIG. 11 is a perspective illustration of another embodiment of the sheet size-detection mechanism used with the sheet cassette according to the invention.
Figure 12:
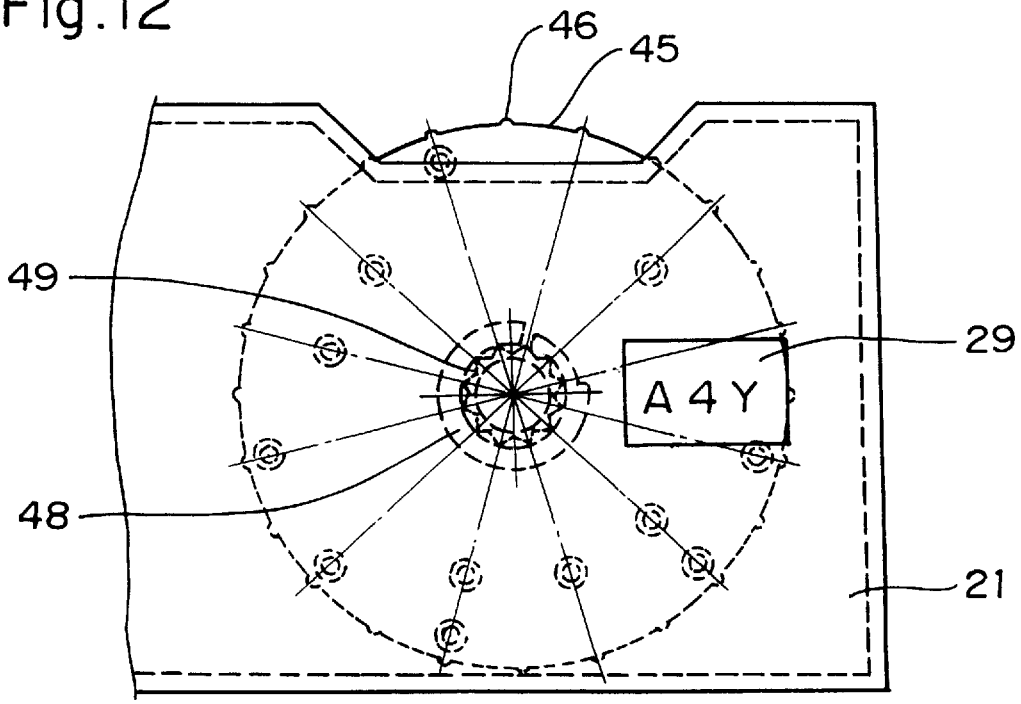
FIG. 12 is an upper illustration of another embodiment of the sheet size-detection mechanism used with the sheet cassette according to the invention, FIGS. 13(*a*)–13(*c*) show an illustration of the process of the ratchet mechanism of another embodiment of the ratchet mechanism in FIG. 12, FIGS. 14(*a*)–14(*c*) show an illustration of the process of the ratchet mechanism of another embodiment of the ratchet mechanism in FIG. 12, FIGS. 15(*a*) and 15(*b*) show a constructional illustration of a further embodiment of the sheet size-detection mechanism used with the sheet cassette according to the invention, 15(*a*) being at a first position and 15(*b*) being at a second position rotated by 30 degrees from the first position.

As shown in FIGS. 11 and 12 and as is the case with the first embodiment of the invention mentioned above, a display window 29 is provided in a portion of the front panel 21 of a sheet cassette 2 that extends laterally from a cassette holder 20, and a size-indication mechanisms shown at 45–49 are located on the back side thereof.

The size-indication mechanism includes a disk form of rotary indicator/label support member 45, and the rotary disk 45 bears on its side be connected to the front panel 21 letters that indicate the sheet size to be displayed, such as B3, A3, B4, A5, and so on. The rotary disk 45 is provided on its periphery with a number of ribs 46 allowing the operator to rotate it easily with the fingers. As shown in FIG. 12, a part of the upper end of the front panel 21 is cut away, so that the upper end of the rotary disk 45 can be exposed to open view, thereby enabling the operator to turn it easily. The rotary disk 45 is provided with a ratchet mechanism. The detailed structure of the ratchet mechanism will be explained later. As the rotary disk 45 turns, there is a stable point per each given angular position, and an additional rotational force is needed for turning the rotary disk 45 from that stable point. At this angular position at which there is a stable point, the sheet size-indicating letters mentioned above are found in the central region of the display window 29, so that the operator can visually confirm the size of sheets contained in the sheet cassette 2. After this, the operator turns the rotary disk 45 to display the letters 47 indicating that sheet size in the display window 29.

The back (rear) side of the rotary disk 45 is provided with push members—which define marker (or size-definition) member 44—at predetermined positions corresponding to the sheet size-indicating letters on the front side, for instance, just at the back of those letters, as shown in FIG. 11 by way of example. The push members are made up of 0 through 3 projections of the same shape. These three projections are provided on the rotary disk 45 such that they are arranged on the radial line from the axis of the rotary disk 45 and in line in the order of the first, second and third. It is noted that how to mount each projection in place will be explained later. In the example shown in FIG. 11, two, or the first and third, projections are assigned to size A4, but the second projection is not used. Likewise, one, or the third, projection is assigned to size B5, and one, or the second, projection to size B4. Although no illustrative examples are given to other sizes, it is understood that three bits in all or eight sizes can be transmitted.

Three switches 10-1 to 10-3 are located at positions of the hardware body 1 on which pushes are given when the cassette 2 having the thus preset sheet size indication is inserted into the slot 11 in the hardware body 1. In the above-mentioned example of size A4, however, pushes are given on two switches 10-1 and 10-3 alone, because the two projections alone are provided. Accordingly, the combination of these three switches is transmitted to the hardware body 1 in the form of a 3-bit electrical signal "101" meaning size A4 by an electronic circuit including these switches according to the preset promise.

The projections serving as the push members are fitted into holes in the rotary disk 45. If the rotary indicator 45 has an insufficient thickness, however, it is then preferable that holes are formed in columns attached to the rotary disk 45 in the axial direction. If the thickness of the rotary disk 45 permits, threaded holes may then be formed in the rotary disk 45 so as to screw projection, each externally threaded at one end, into them.

Although the projections serving as the push members are illustrated as square columns in FIG. 11, it is understood that they are not always required to be in square column configuration and are of other configuration, for instance, cylindrical column configuration, as desired.

The first embodiment of the ratchet mechanism for the rotary disk 45 will now be explained more specifically with reference to FIGS. 11 and 12. The rotary disk 45 is provided with a concentric hole 45*a*. On the other hand, the front panel 21 is fixedly provided with a gear 49 on the concentric axis of the rotary disk 45. The tooth pitch of the gear 49 is defined by the stable point-lying angular space mentioned above. The circumference of the gear 49 is of size selected such that it fits into the concentric hole 45*a* mentioned above. This concentric hole 45*a* is provided at its one location with a pawl 48. This pawl 48 is projected by a spring, not shown, from the concentric hole 45*a* toward its axial direction (between the teeth of the gear 49), but is retracted to the inner edge surface upon pushed circumferentially. Accordingly, when the rotary disk 45 is rotated around the gear 49 while it is fitted into the concentric hole 45*a* in the rotary disk 45, the rotary disk 45 is stabilized while the pawl 48 lies at the angular position between the teeth of the gear 49. In order to turn the rotary disk 45, there is needed a force that permits the teeth of the gear 49 to push the pawl 48 in the circumferential direction against the spring force.

For this reason, the rotary disk 45 is ratchetted between the teeth of the gear 49. This ratchet mechanism is provided inexpensively with a reduced number of parts, because each part can be formed of resin.

The second embodiment of the ratchet mechanism for the rotary disk 45 will now be explained more specifically with reference to FIG. 13. As in the gear 49 according to the first embodiment, a gear 49 is fixed on the back side of a front panel 21 by a shaft, not shown. The rotary disk 45 is provided with a cylinder 45*b* by one-piece molding of resin, the cylinder 45*b* having an inner diameter conforming to the contour of the gear 49. A part of the cylinder 45*b* is provided with a notch 45-1 parallel with its axial direction, and the cylinder 45*b* is decreased in thickness from the notch 45-1 over an angular range of approximately 60°, forming a spring portion 45-2 that is bent in the axial direction. The spring portion 45-2 is provided at its distal end with an extension 45-3 that extends inwardly. The extension 45-3 is such shaped as to fit into the trough between the teeth of the gear 49.

Figure 13A:
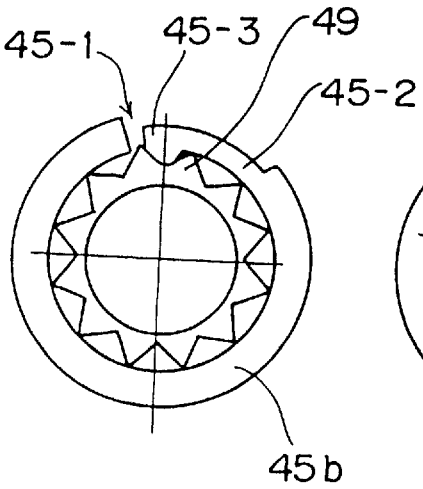
Figure 13B:
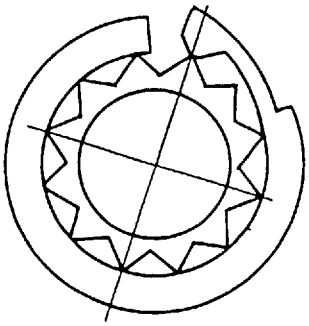
Figure 13C:
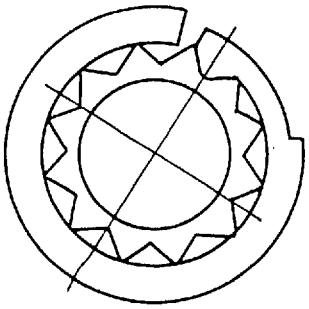

As the rotary disk 45 turns clockwise, the extension 45-3 is forced outwardly by the teeth of the gear 49 (see FIG. 13(B)). As the rotary disk 45 continues to turn, the extension 45-3 engages the next tooth trough of the gear 49 (see FIG. 13(C)) and is stabilized there. This process is illustrated in FIGS. 13(A), (B) and (C).

Thus, the ratchetting action is achieved. The ratchet mechanism according to the second embodiment is again provided inexpensively, because each of the parts can be formed of resin.

Figure 14A:
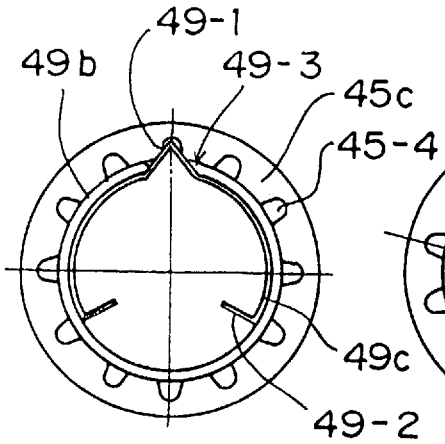
Figure 14B:
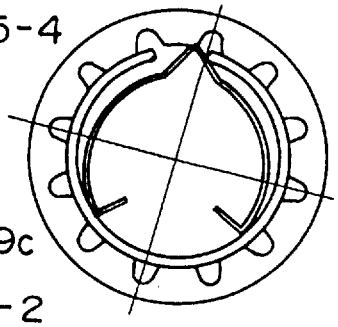
Figure 14C:
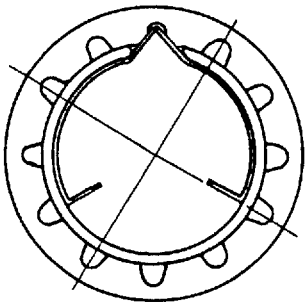

The third embodiment of the ratchet mechanism for the rotary disk 45 will now be explained more specifically with reference to FIG. 14. The rotary disk 45 is provided with a first cylinder 45*c* concentric with its rotary shaft by one-piece molding of resin. The cylinder 45*c* is provided on its inside with grooves 45-4 at angular intervals of 30° in the direction parallel with the axis of the cylinder 45*c*. On the other hand, a second cylinder 49*b*—that has an outer diameter fit to the inner diameter of the first cylinder 45*c*—is allowed to extend from the rear side of the front panel 21 by one-piece molding of resin. A part of the second cylinder 49*b* is provided with a notch 49-3 parallel with the its axial direction. Furthermore, a spring sheet 49*c* is fitted into the second cylinder 49*b* over an area commensurate with an angle of 180° or more, for instance, 240°, said spring sheet 49*c* having an outward projection 49-1 at the center of that 240°. Thus, the outward projection 49-1 extends through the notch 49-3 in the cylinder 49*b*, engaging within the groove 49-1 in the first cylinder 45*c*. As the rotary disk 45 turns clockwise, the first cylinder 45*c* turns in unison therewith, so that the projection 49-1 on the spring sheet 49*c* can be pushed inwardly, leaving the groove 45-4. This is due to the deformation of the spring sheet 49*c*, as illustrated in FIGS. 14(A) and (B). As the rotary disk 45 continues to turn further, the projection 49-1 engages within the next groove, where it is stabilized, as shown in FIG. 14(C). It is noted that the spring sheet 49*c* is inwardly bent at both its ends 49-2 so as to improve its sliding movement with the inner face of the cylinder 49*b* and for easy handling. In the instant embodiment, use may be made of wire material instead of the spring sheet 49*c*.

Another embodiment of the invention will now be explained at great length with reference to FIGS. 15 through 17.

Figure 15A:
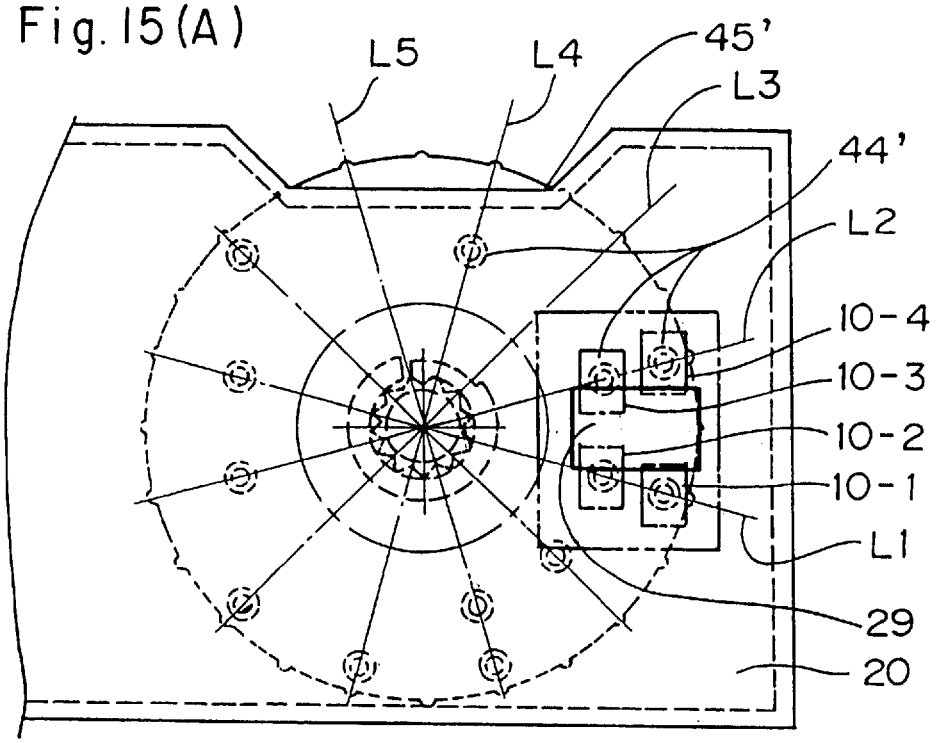
Figure 15B:
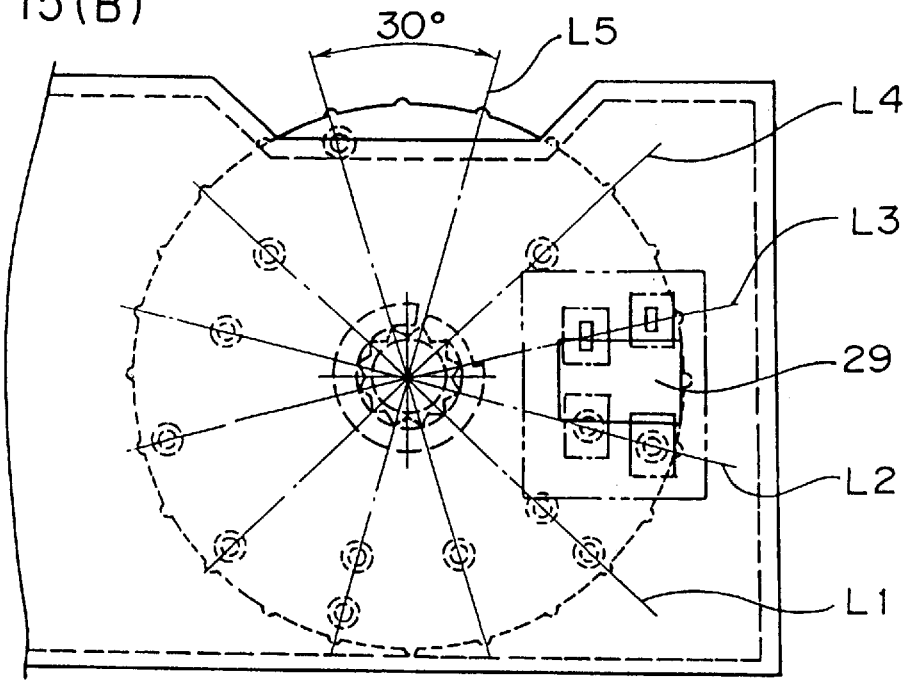

As shown in FIG. 15, a rotary indicator disl/label support member 45' is kept stable at 12 positions. Radial rows L1, L2, L3, . . . corresponding to the positions may each be provided with two push members (projections) 44' or two-bit push members 44'. As shown in FIG. 15(*a*) at the first position, the first and second rows L1 and L2 positioned inside a display window 29 are each provided with the push members 44' at two bits, which generate four-bit signals "1111". Corresponding to the four positions in all, there are four switches 10-1 through 10-4 on the side of the hardware body, which, when pushed by the associated push members, generate a four-bit electrical signal. In FIG. 15(*b*), there is shown the second position to which the rotary indicator disk 45' turns from the first position by 30 degrees. Since the third row L3 contains no push member, the second and third rows L2 and L3 generate a signal "1100". As the rotary disk 45' turns by an additional 30 degrees, the third and fourth rows L3 and L4 generates a signal "0010". As the rotary disk 45' turns by a further 30 degree, the fourth and fifth rows L4 and L5 generate a signal "0100". Likewise, two-bit×two-row or four-bit signals can be generated. This arrangement has the advantage of being capable of being decreased in radius, because it can express multi-bit information with a reduced number of push members alone disposed in the radial direction.

Now assume that a size-indication letter is described between two rows on the rotary disk 45' (e.g., between L1 and L2). Then, 12 letters can be described, as shown in FIG. 16, because there are 12 rows. The code for each size-indication letter can then expressed by a two-row×two-bit projection that defines the boundary line for that letter.

This means that it is possible to express letters corresponding to four bits by providing a projection space corresponding to two bits in the circumferential direction of the rotary disk 45'.

Figure 16:
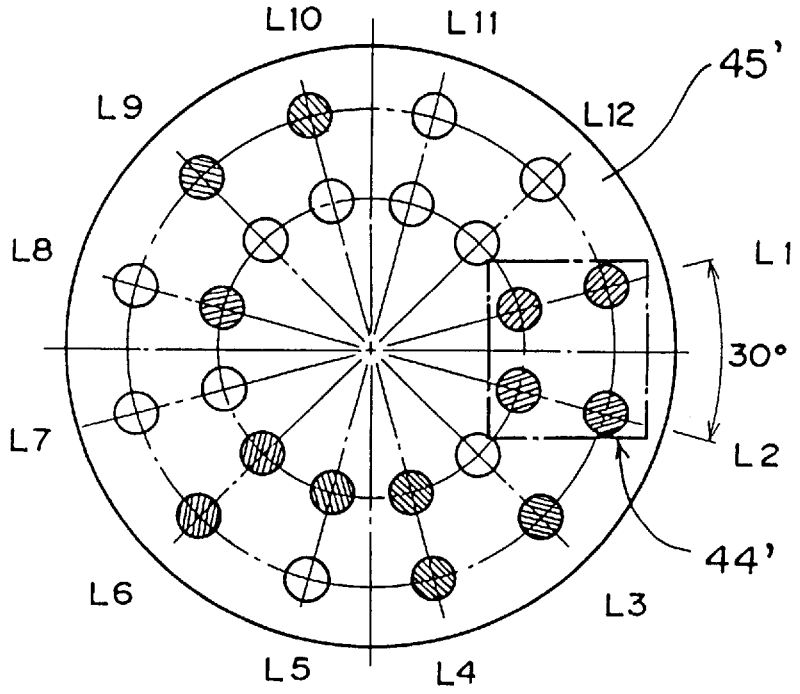
FIG. 16 is a constructional illustration of the size-definition member in FIG. 15.
Figure 17:
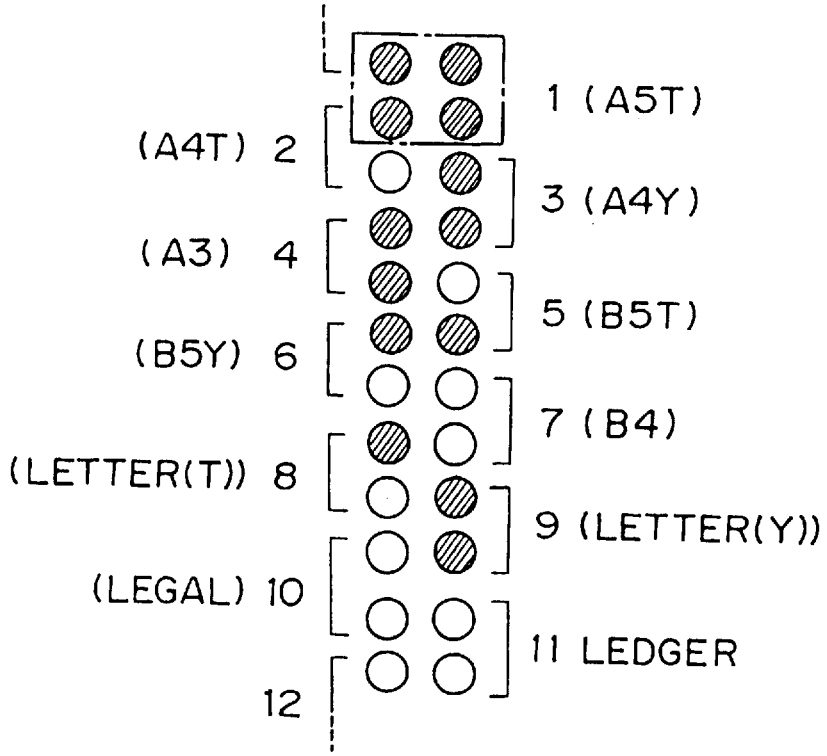
FIG. 17 represents the relation between the size-definition member in FIG. 16 and sheet size.

This two-bit×two-row construction may be determined, as shown in FIG. 16, thus preventing two-bit×two-row data showing each letter from overlapping with each other. In FIG. 16, hatched circles show an "on-state" indicating the presence of the projection. Thus, the space between the rows L1 and L2 indicates size A5, lengthwise; the space between L2 and L3 size A4, lengthwise; the space between L3 and L4 size A4, widthwise; the space between L4 and L5 size A3; the space between L5 and L6 size B5, lengthwise; the space between L6 and L7 size B5, widthwise; the space between L7 and L8 size B4; the space between L8 and L9 letter size, lengthwise; the space between L9 and L10 letter size, widthwise; the space between L10 and L11 legal size; the space between L11 and L12 ledger size; and the space between L12 and L1 a blank, as shown in FIG. 17.

Such two-row projections are inexpensive to fabricate, because they can be molded as a piece integral with the rotary indicator disk 45'.

A further embodiment of the invention will now be explained at great length with reference to FIG. 18.

Figure 18:
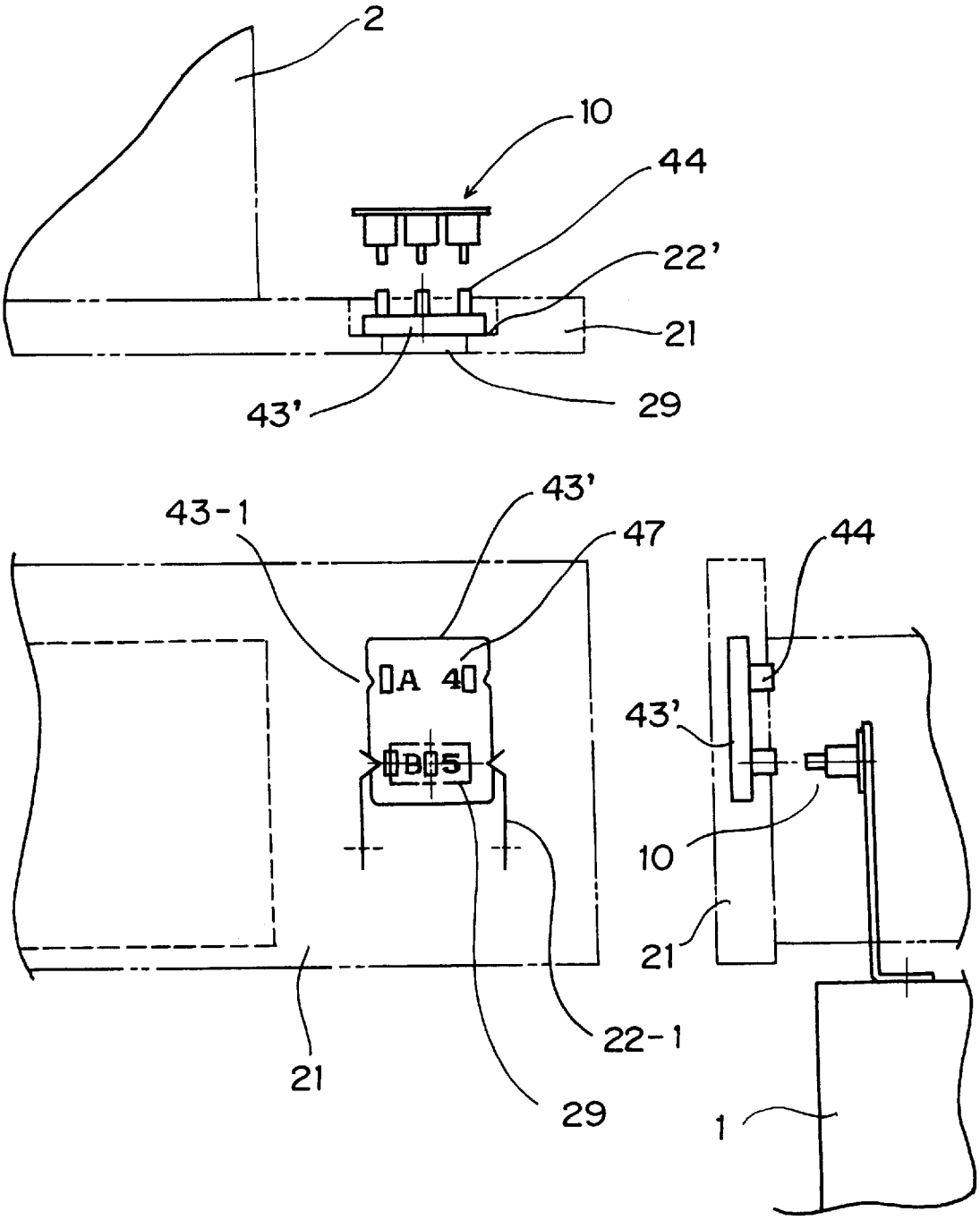
FIG. 18 is a constructional illustration of a further embodiment of the sheet size-detection mechanism used with the sheet cassette according to the invention, and FIGS. 19(*a*) and 19(*b*) and 20 illustrate the prior art.
Figure 19B:
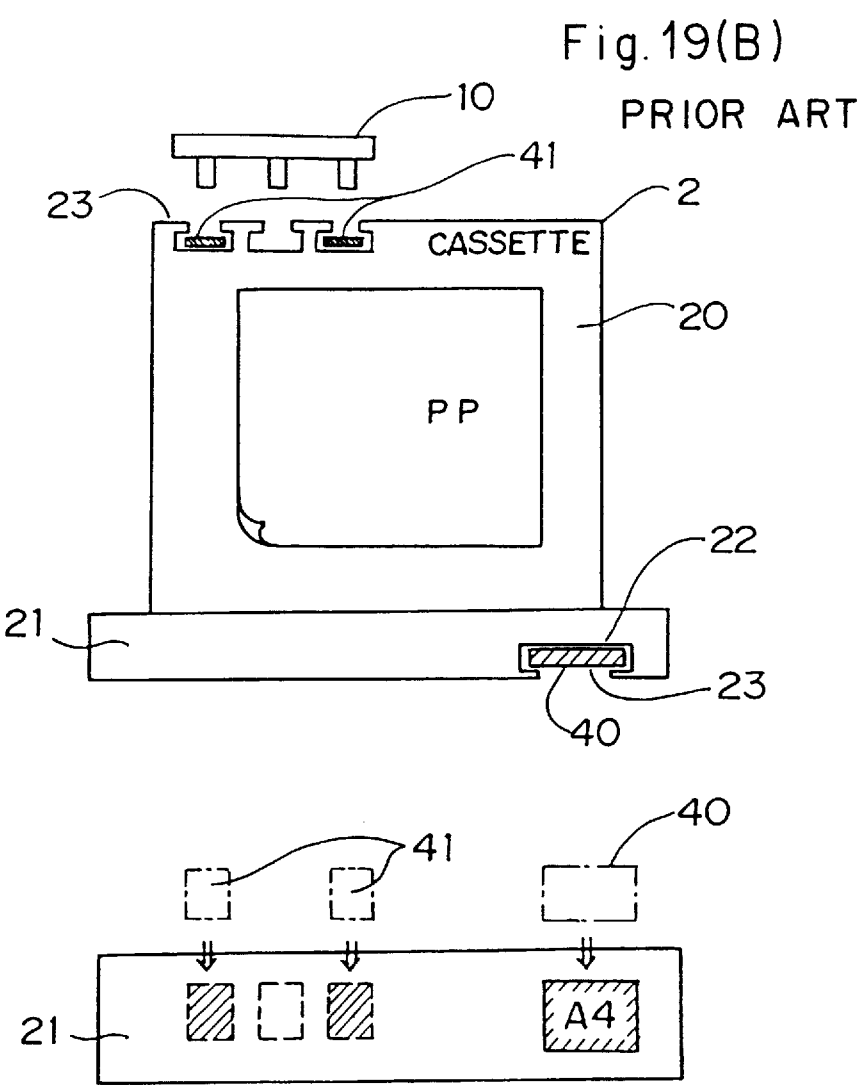
Fig. 19(B) PRIOR ART
Figure 19A:
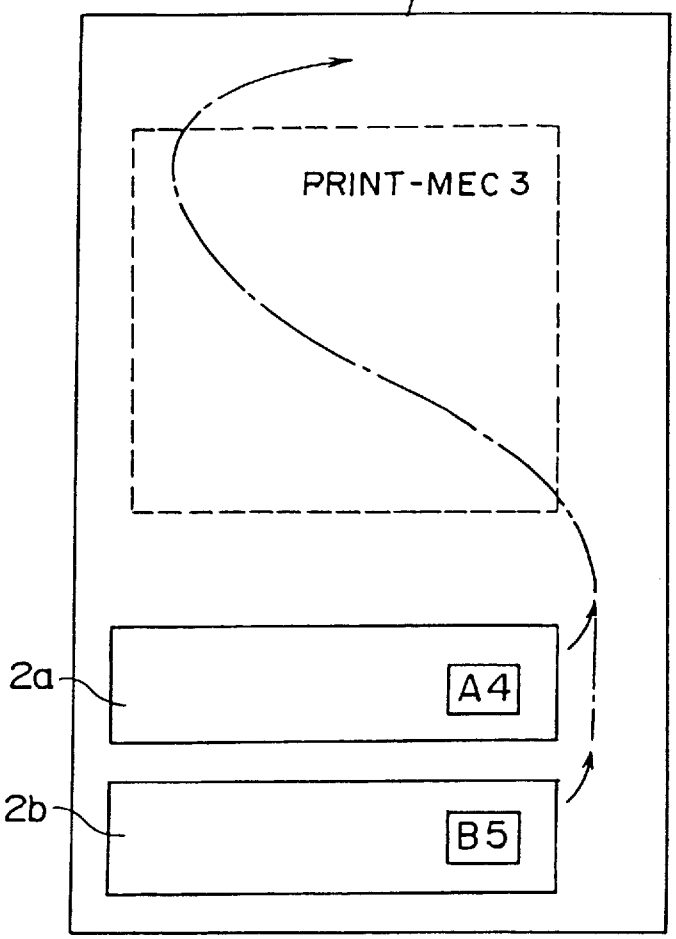
Fig. 19(A) PRIOR ART
Figure 20:
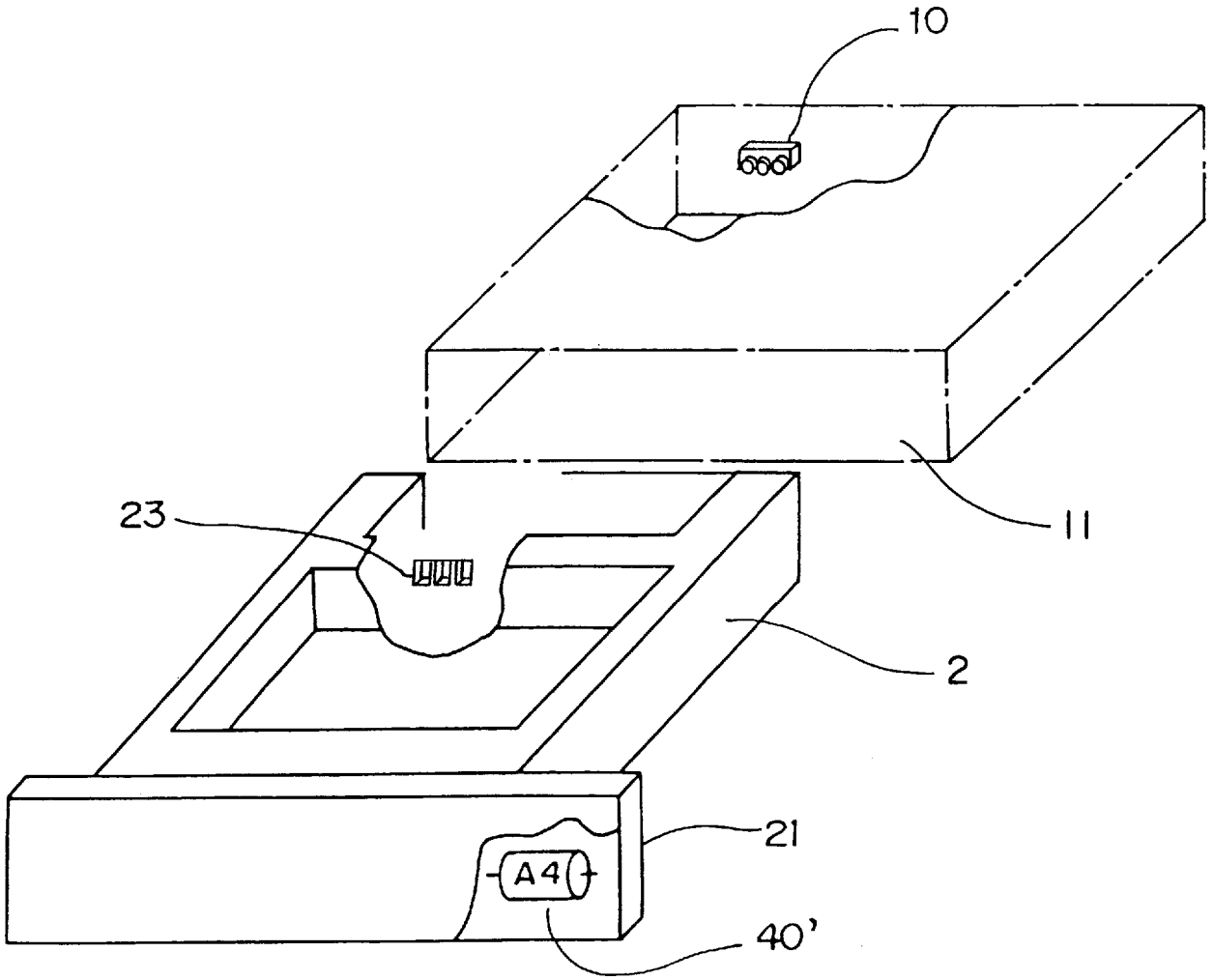
Fig. 20 PRIOR ART

In the embodiment shown in FIG. 18, linear motion is applied to the switchover of a size display mechanism. In FIG. 18, there are given a plan view in the left-upper region, a front view in the left-lower region and a side view in the right-lower region. A sliding indicator sheet/label support member 43' comes in plane contact with a recess 22' formed in the back side of a front panel 21, and bears on the front side letters 47 indicating sheet sizes, for instance, "A4" and "A5". The sliding indicator sheet 43' is provided with a pair of notches 43-1 in a substantially triangular form on the sides along the sliding direction (the vertical direction in FIG. 18). Furthermore, a pair of springs 22-1 are provided in the recess 22' in the front panel 21 such that these notches 43-2 are sandwiched between them. The distal ends of the springs 22-1 are each in a substantially triangular form, as in the notches 43-1, so that they can be stably engaged within the notches 43-1 and disengaged from the notches 43-1 with suitable force. Accordingly, the sliding indicator sheet 43' is kept stable while the springs 22-1 are engaged within the notches 43-1, so that the letters 47 can be selectively seen through the display window 29 provided on the front panel 21 from the front of the hardware. For the switchover of the letters to be displayed, it is required for the operator to displace the sliding indicator sheet 43' vertically with the force that can set off the forces of the springs 22-1. Accordingly, the notches 43-1 and springs 22-1 form a ratchet mechanism. The sliding indicator sheet 43' is provided on the back side with push members 44 serving as marker means corresponding to the displayed sheet size. These push members 44, each in a rod form, project from the back side of the indicator sheet 43'. When sheets are of size A4, two projections are located at two of three given positions with no projection located at the intermediate position. When the cassette 2 is loaded in the slot 11 in the hardware, pushes are given on only two—that are located on both sides—of the three switches 10 located at the positions opposite to the projections, as is the case with the above-mentioned embodiment, whereby they are actuated. While the instant embodiment has been described as expressing two pieces of information in terms of three bits for the purpose of simplification, it is understood that the invention is applicable to many more pieces of information and a much larger bit number.

While three ratchet mechanisms have been described in the foregoing, it is understood that the invention can make use of other available mechanisms such as one wherein balls are guided by a spring into a shallow hole.

While the foregoing embodiments have been described as attaching the push members to the display panel, it is understood that encoding may be implemented by forming holes or dents in the display panel.

While the foregoing embodiments have been described as using mechanical push-operable switches as the detection means built in the hardware, it is understood that the detection of the parts in which the information displayed on the front panel is encoded may be carried out by using other means such as optical or magnet switches.

While the foregoing embodiments have been described as using push members for encoding the information displayed on the front panel, it is understood that a bar mark may be used as the encoding means and its detection may be carried out by using light reflected off the mark.

While the embodiment shown in FIG. 11 has been described as turning the rotary display panel by the ribs provided on its circumference, it is understood that the same may be achieved by other turning means.

As many apparently widely different embodiments of the invention can be made without departing from the spirit and scope thereof, it is to be understood that the invention is not limited to the specific embodiments thereof except as defined in the appended claims.

What we claim is:

1. A sheet size-detection mechanism on a sheet cassette for sheet size-detection by hardware into which the sheet cassette is loaded, said sheet size-detection mechanism comprising:

sheet size display means for displaying sheet sizes on a front panel of said sheet cassette;

sheet size definition parts having different arrangements defining corresponding sheet sizes of said sheet size display means, extending from said sheet size display means and contactable with the hardware; and a rachet mechanism disposed in said sheet size display means to fix said sheet size display means at positions corresponding to respective sheet sizes of said sheet size display means, said rachet mechanism having a cylinder with grooves formed on an inner perimeter and a spring sheet disposed within said cylinder with a movable projection to catch said grooves.

2. A sheet size-detection mechanism on a sheet cassette for sheet size-detection by hardware into which the sheet cassette is loaded, said sheet size-detection mechanism comprising:

sheet size display means for displaying sheet sizes on a front panel of said sheet cassette;

sheet size definition parts having different arrangements defining corresponding sheet sizes of said sheet size display means, extending from said sheet size display means and contactable with the hardware; and a rachet mechanism disposed in said sheet size display means to fix said sheet size display means at positions corresponding to respective sheet sizes of said sheet size display means, said rachet mechanism having a gear with teeth and a cylinder surrounding said gear with a spring portion having an extension movably fitted in spaces between said teeth of said gear.

3. A sheet size-detection mechanism on a sheet cassette for sheet size-detection by hardware into which the sheet cassette is loaded, said sheet size-detection mechanism comprising:

a display window on a front panel of the sheet cassette; and, a rotary disk, disposed on the front panel of the sheet cassette, having:

sheet size indicators, positioned on a front side of said disk facing said display window, for display through said display window;

sheet size definition parts having different arrangements defining corresponding sheet sizes of said sheet size indicators, extending from a back side of said disk and contactable with the hardware; and a rachet mechanism disposed in a center of said rotary disk to fix said rotary disk at positions corresponding to respective sheet sizes of said sheet size indicators, said rachet mechanism having a cylinder with grooves formed on an inner perimeter and a spring sheet disposed within said cylinder with a movable projection to catch said grooves.

4. A sheet size-detection mechanism on a sheet cassette for sheet size-detection by hardware into which the sheet cassette is loaded, said sheet size-detection mechanism comprising:

a display window on a front panel of the sheet cassette; and, a rotary disk, disposed on the front panel of the sheet cassette, having:

sheet size indicators, positioned on a front side of said disk facing said display window, for display through said display window;

sheet size definition parts having different arrangements defining corresponding sheet sizes of said sheet size indicators, extending from a back side of said disk and contactable with the hardware; and a rachet mechanism disposed in a center of said rotary disk to fix said rotary disk at positions corresponding to respective sheet sizes of said sheet size indicators, said rachet mechanism having a gear with teeth and a cylinder surrounding said gear with a spring portion having an extension movably fitted in spaces between said teeth of said gear.

5. An image-forming apparatus having a sheet cassette loaded therein, comprising:

a sheet cassette for containing sheets;

said sheet cassette having a rear wall, a front panel opposite to said rear wall, and two side walls extending between said front and rear walls;

said apparatus including a slot into which sheet cassette is loaded, said cassette being adapted to be inserted into said slot of the image-forming apparatus rear end first;

said front panel having an outer surface which is visible from outside said apparatus when said cassette is inserted, said front panel being generally flat and having a display window located on a laterally extending side portion which includes a through hole formed therein;

a label slot disposed on the backside of said laterally extending side portion;

a generally flat sheet size display label which is laterally slidable within said label slot;

said generally flat sheet size display label having a plurality of letters at separate positions on a front surface thereof;

said label being disposed within said label slot with said plurality of letters being individually viewable on a front side of said front panel through said through hole;

said generally flat sheet size display label including sheet size-definition projection members supported by and extending off from a rear surface of said generally flat sheet size display label, said sheet size-definition projection members being located at positions corresponding to the positions of said letters;

sheet size-detection switches, supported on said apparatus proximate said slot, for detecting said sheet size-definition projection members of said sheet size display means which are at a location proximate thereto, thereby detecting the sheet size indicated on said display window;

a ratchet mechanism for fixing the generally flat sheet size display label in the label slot at respective positions with a single one of said letters positioned within said display window and with at least one corresponding sheet size-definition projection member at said location proximate the sheet size-detection switches;

said generally flat sheet size display label being configured to be manually grasped such that one can manually move said label within said label slot to an appropriate position therein;

wherein said generally flat sheet size display label is linearly slidable within said slot, and wherein said letters are located at separate linear positions along said label; and wherein said ratchet mechanism includes notches formed on opposing sides of a widthwise perimeter surface of said generally flat sheet size display label and springs having portions which are fitted within said notches.

* * * * *